US010716348B2

(12) United States Patent
Dozier

(10) Patent No.: US 10,716,348 B2
(45) Date of Patent: Jul. 21, 2020

(54) WIG MAKING TOOLS AND KIT

(71) Applicant: Irma Faye Dozier, Jonesboro, GA (US)

(72) Inventor: Irma Faye Dozier, Jonesboro, GA (US)

( * ) Notice: Subject to any disclaimer, the term of this patent is extended or adjusted under 35 U.S.C. 154(b) by 498 days.

(21) Appl. No.: 15/475,588

(22) Filed: Mar. 31, 2017

(65) Prior Publication Data

US 2017/0280801 A1 Oct. 5, 2017

Related U.S. Application Data

(60) Provisional application No. 62/318,364, filed on Apr. 5, 2016.

(51) Int. Cl.

| | |
|---|---|
| ***A41G 3/00*** | (2006.01) |
| ***D04B 3/02*** | (2006.01) |
| ***D05B 85/02*** | (2006.01) |
| ***D05B 85/06*** | (2006.01) |

(52) U.S. Cl.

CPC ..... *A41G 3/0066* (2013.01); *D04B 3/02* (2013.01); *D05B 85/02* (2013.01); *D05B 85/06* (2013.01)

(58) Field of Classification Search

CPC ..... A41G 3/0066; A41G 3/0075; D04B 3/02; D04B 85/02; D04B 85/06; D04B 85/006; A01K 83/06; A01K 83/00; D05B 3/02; D05B 85/02; D05B 85/06; D05B 85/006

See application file for complete search history.

(56) References Cited

U.S. PATENT DOCUMENTS

| | | | | | |
|---|---|---|---|---|---|
| 100,112 | A | | 2/1870 | Boone | |
| 310,118 | A | * | 12/1884 | Bower | A01K 83/00 43/43.16 |
| 559,108 | A | * | 4/1896 | Stimson | D05B 85/00 223/102 |
| 1,293,660 | A | * | 2/1919 | Armstrong | D05B 85/00 223/102 |
| 1,471,576 | A | * | 10/1923 | Skinner | A45D 8/02 132/280 |
| 1,601,292 | A | * | 9/1926 | Burns | A01K 83/00 43/44.83 |
| 1,875,182 | A | * | 8/1932 | Southwell | A01K 83/00 43/44.82 |
| 2,042,403 | A | * | 5/1936 | Rivnak | D05B 87/00 223/99 |
| 2,465,636 | A | | 3/1949 | Doerr | |
| 2,635,444 | A | | 4/1953 | Carlson et al. | |
| 2,266,749 | A | | 12/1953 | Corsillo | |
| 2,677,485 | A | | 5/1954 | Surbeck | |
| 2,740,568 | A | * | 4/1956 | Ostergaard | D05B 85/02 223/102 |
| 3,077,891 | A | | 2/1963 | Lane | |
| 3,581,688 | A | | 6/1971 | Ketterer | |
| 3,678,712 | A | * | 7/1972 | Singleton | D04B 3/00 66/118 |
| 3,696,764 | A | | 10/1972 | Merkle | |
| 3,867,888 | A | | 2/1975 | Morissette | |

(Continued)

*Primary Examiner* — Nicholas D Lucchesi

(74) *Attorney, Agent, or Firm* — Ballard Spahr LLP

(57) ABSTRACT

A tool designed for fixing fibers, such as natural hair, to a substrate, such as a wig cap, for making hand-tied wigs, having a shaft with two ends. A slot extends from one of the shaft ends with an open end to receive fibers. An opening extends transversely to the shaft and intersects with the slot for holding fibers as they are passed through the openings of the wig cap.

9 Claims, 3 Drawing Sheets

(56) References Cited

U.S. PATENT DOCUMENTS 3,878,637 A * 4/1975 Flower ..... A01K 83/00 43/44.83
3,927,538 A * 12/1975 Martella ..... D04B 3/02 66/117
3,999,877 A * 12/1976 Ketterer ..... D05B 1/24 112/227
4,092,796 A * 6/1978 Adams ..... A01K 83/00 43/44.83
4,107,953 A 8/1978 Casillo
4,343,321 A * 8/1982 Caranicas ..... A45D 6/14 132/276
4,577,665 A 3/1986 Diesner
4,750,291 A * 6/1988 Chilton ..... A01K 83/00 43/44.82
4,784,713 A 11/1988 Van Nieulande
4,886,003 A 12/1989 Walker
5,289,834 A * 3/1994 Lawrence ..... A45D 8/34 132/212
5,657,776 A * 8/1997 Espenschied ..... A45D 8/00 132/200
5,881,491 A * 3/1999 Kira ..... A01K 83/00 43/44.83
5,881,738 A * 3/1999 Villani ..... A45D 8/00 132/207
6,006,965 A * 12/1999 Hamann ..... D05B 87/00 223/102
6,481,149 B1 * 11/2002 Hall, IV ..... A01K 83/00 43/43.16
7,168,377 B2 1/2007 Fukuyama
D553,849 S * 10/2007 Snyder ..... D3/18
8,151,720 B2 4/2012 Turner
8,336,559 B2 12/2012 Kallabat et al.
8,479,541 B1 * 7/2013 Baily ..... D04B 3/02 66/117
8,578,946 B2 11/2013 Ellery
8,608,763 B1 * 12/2013 Jurbala ..... A61B 17/32003 606/170
8,859,926 B2 10/2014 Freelove
8,863,760 B2 10/2014 Verbonac
8,978,644 B2 3/2015 Springfield-Thomas
9,033,196 B1 5/2015 Smith
2001/0025446 A1 * 10/2001 Asada ..... A01K 83/00 43/43.16
2003/0071094 A1 * 4/2003 Shau ..... B65H 75/28 223/102
2004/0134509 A1 * 7/2004 Belton ..... A45D 8/34 132/273
2013/0025181 A1 * 1/2013 Sugano ..... A01K 83/00 43/43.16
2013/0133240 A1 * 5/2013 Beitzel ..... A01K 83/00 43/43.16
2014/0259871 A1 * 9/2014 Sano ..... A01K 83/00 43/43.2
2016/0057981 A1 * 3/2016 Beecher ..... A01K 83/00 43/43.12
2016/0242398 A1 * 8/2016 Dampier ..... A01K 85/01

* cited by examiner

WIG MAKING TOOLS AND KIT

CROSS REFERENCE TO RELATED APPLICATION

This application is based upon and claims priority to U.S. Provisional Application No. 62/318,364 filed Apr. 5, 2016 and is hereby incorporated by reference herein.

FIELD OF THE INVENTION

The present disclosure relates to tools and a kit for the manufacture of wigs and hairpieces.

BACKGROUND

Wigs and hairpieces are worn by both genders for a variety of reasons, including but not limited to, medical (e.g., illness, untoward effects of chemotherapy, alopecia), personal (e.g., fashion accessory), and professional (e.g., theater, television journalists and others in the public eye). Wigs and hairpieces, however, are expensive, and often require sophisticated equipment. Finding an inexpensive wig that is comfortable and undetectable can be an exhausting process. Hand-tied wigs, on the other hand, are well-known to fit and provide a more natural look.

Hand-tied wigs can be customized to fit the head more naturally, eliminate the search for a wig that not only fits a particular head shape, but can also be designed to have the look of natural hair, color, style, texture and hairline, and to be lighter. Making a wig by hand can be a tedious process. The currently available tools used in the manufacture of hand-tied wigs are difficult to use for some wigmakers, especially beginners. Machines for making wigs are expensive and are not practical for individual wigmakers. A need exists in the field of wig manufacture for tools and a kit for fixing a plurality of hairs to a substrate (e.g., wig cap) that is easy to use by wigmakers, including beginners and those with a decreased dexterity, that reduce frustration, and save time and money.

SUMMARY

The invention concerns a tool for fixing fibers to a substrate. The tool comprises a shaft having first and second ends. In one example embodiment the tool has a slot that extends from the first end of the shaft lengthwise therealong. The slot has an open end for receiving the fibers. A first opening extends transversely to the shaft and intersects the slot. In an example embodiment the first opening is wider than the slot and has a diameter from 120 μm to 510 μm. In a further example embodiment a second opening extends transversely to the shaft and intersects the slot. The second opening is wider than the slot in spaced relation away from the first opening. The first and second openings have a circular cross section.

In an example embodiment the tool comprises first and second guide surfaces. The first and second guide surfaces are positioned at the first end of the shaft with the second guide surface adjacent to the first guide surface. Both guide surfaces are angularly oriented with respect to a longitudinal axis of the slot. The slot has a width from 50 μm to 500 μm. In one example embodiment, the first and second guide surfaces terminate in first and second rounded edges, respectively, at the first end of the shaft. The shaft is curved.

The invention further encompasses a tool for fixing fibers to a substrate comprising a container defining a volume and having a smooth curved inner surface. In an example embodiment the container has a bulbous shape. A tube extends from the container. The tube defines a smooth bore in fluid communication with the volume. The diameter of the tube is from 50 μm to 500 μm. The tube has an open end for receiving the fibers opposite to the container. In an example embodiment the ends of the fibers are inserted through the tube into the container, engage the smooth curved inner surface of the container and are guided back into the tube.

In one example embodiment the tool comprises at least one projection that extends outwardly from the tube. In a further example embodiment the tool comprises a plurality of projections extending outwardly from the tube. Projections are positioned at the open end of the tube.

The invention further encompasses a kit for fixing fibers to a substrate. The kit comprises a tool and a stand. The stand holds fibers and comprises a base and at least one projection. The projection extends transversely to the base. In an example embodiment the kit comprises a first and second tool. In one example embodiment the first tool comprises a shaft having a first end and a second end. A slot extends from the first end of the shaft lengthwise therealong. The slot has an open end for receiving the fibers. A first opening extends transversely to the shaft and intersects the slot. The first opening is wider than the slot. In one embodiment the second tool comprises a container defining a volume and having a smooth curved inner surface. A tube extends from the container. The tube defines a smooth bore in fluid communication with the volume. The tube has an open end opposite to the container for receiving the fibers. The ends of the fibers are inserted through the tube into the container, engage the smooth curved inner surface and are guided back into the tube.

DETAILED DESCRIPTION

Figure 1:
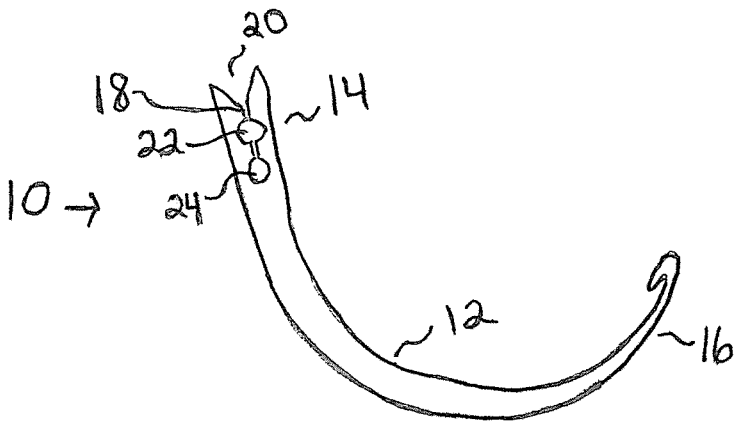
FIG. 1 is a side view of an example embodiment of a tool according to the present disclosure.

FIG. 1 shows an example embodiment of a tool 10 for fixing fibers, such as natural hair, to a substrate, such as a wig cap, for making a wig. Tool 10 comprises a shaft 12 having first and second ends 14 and 16. A slot 18 extends lengthwise along shaft 12 from the first end 14. Slot 18 has an open end 20 for receiving the fibers as described below. At least a first opening 22 extends transversely to the shaft 12. First opening 22 intersects slot 18 and is wider than the slot 18. In this example embodiment there is a second opening 24 which also extends transversely to the shaft 12. Second opening 24 also intersects slot 18 and is positioned in spaced relation away from the first opening 22.

As shown in FIG. 1, shaft 12 is curved having a second end 16 in an optional hook configuration. In this example embodiment the optional hook is positioned at the second end 16 of the shaft 12. The hook may have a rounded bottom side and extend toward a longitudinal axis 88 of open end 20 of slot 18. The side faces of the optional hook may be bulging and rounded blending into the tapered portion of shaft 12. Alternatively, the side faces of the optional hook may be relatively wide and flat and continuous with the shaft 12.

Referring to FIG. 1, shaft 12 is tapered terminating in second end 16, and is of a generally circular cross section. The shaft 12 may be curved or straight. In certain embodiments, the shaft 12 has a length between 1 and 5 inches. The diameter of the shaft 12 may be about 0.01 inches to 0.20 inches. The tapered portion of the shaft 12 may be of any length. In certain embodiments, the length of the tapered portion of the shaft 12 may be between 0.25 and 4 inches.

Figure 2:
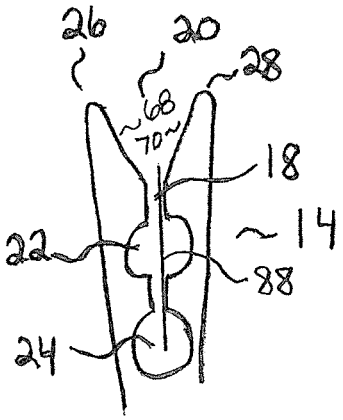
FIG. 2 is a detailed view of a portion of the tool shown in FIG. 1 on an enlarged scale.

As shown in an enlarged view in FIG. 2, tool 10 comprises a first guide surface 68 at the first end 14 of the shaft 12. In this example embodiment a second guide surface 70 may be positioned at the first end 14 of the shaft 12 adjacent to the first guide surface 68. The guide surfaces 68 and 70 are oriented at an angle with respect to the longitudinal axis 88 of slot 18. The guide surfaces 68 and 70 terminate in first and second edges 26 and 28 at the first end 14 of the shaft 12, respectively. The first and second edges 26 and 28 may be rounded to facilitate its use as described below. The width of the guide surfaces 68 and 70 may be the same or larger than the diameter of slot 18.

Figure 3:
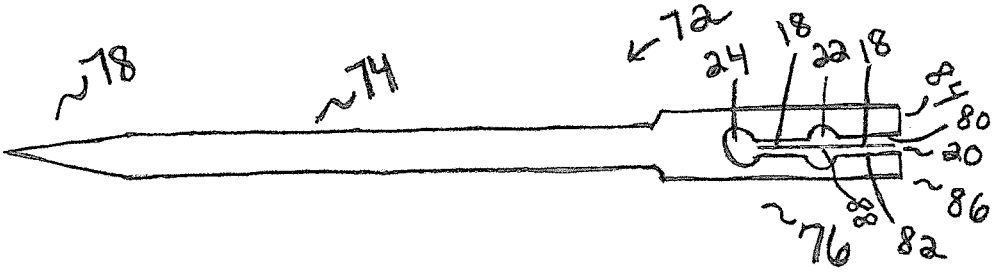
FIG. 3 is a side view of another example embodiment of a tool according to the present disclosure.

FIG. 3 shows an example embodiment of tool 72 for fixing fibers, such as natural hair, to a substrate, such as a wig cap, for making a wig. Tool 72 comprises a shaft 74 having first and second ends 76 and 78. Slot 18 extends lengthwise along shaft 74 from the first end 76. Slot 18 has an open end 20 for receiving fibers as described below. At least a first opening 22 extends transversely to the shaft 74. Similar to tool 10, the first opening 22 intersects slot 18 and is wider than the slot 18. In certain embodiments a second opening 24 extends transversely to shaft 74. The second opening 24 also intersects slot 18 and is positioned in spaced relation away from the first opening 22.

As shown in FIG. 3, shaft 74 is in a straight configuration. In this example embodiment the tip of the second end 78 may be pointed or rounded. The length of the first end 76 is about less than half of the length of the shaft 74. In an example embodiment the width and thickness of the first end 76 is greater than the width and thickness of other elements of shaft 74. For example, the width of the shaft 74 need not be uniform such that the middle portion of the shaft may have a width less than or greater than either the first or second ends 76 and 78, respectively.

Referring to FIG. 3, shaft 74 is tapered terminating in second end 78, and is of a generally circular cross section. The shaft 74 may be curved or straight. In certain embodiments, the shaft 74 has a length between 1 and 5 inches. The diameter of the shaft 74 may be about 0.01 inches to 0.20 inches. The tapered portion of the shaft 74 may be of any length. In certain embodiments, the length of the tapered portion of the shaft 74 may be between 0.25 and 4 inches.

FIG. 3 shows an example embodiment of the tool 72 also comprising a first guide surface 80 at the first end 76 of the shaft 74. A second guide surface 82 may be positioned at the first end 76 of the shaft 12 adjacent to the first guide surface 84. The guide surfaces 80 and 82 are straight with respect to the longitudinal axis 88 of slot 18 forming a right angle at the open end 20. The guide surfaces 80 and 82 are adjacent to a first edge 84 and second edge 86 at the first end 76 of the shaft 74, respectively. The first and second edges 84 and 86 may be rounded to facilitate it use as described below. The width of the guide surfaces 84 and 86 may be the same or larger than the diameter of slot 18.

Referring to tool 10 and 72, the diameter of slot 18 is sufficient to allow fibers to be readily placed in and released from the open end 20 without any restrictions. In certain embodiments, the diameter of slot 18 is about between 0.002 to 0.020 inches (e.g., 50 μm to 500 μm). The slot 18 may extend the full length or a portion of the length of the first end 14. The open end 20 of slot 18 is of a sufficient diameter to accommodate a plurality of fibers without snagging or breaking the fibers. In certain embodiments, the diameter of open end 20 is between 0.03 and 0.10 inches.

Fibers passing through slot 18 via open end 20 intersect with the first opening 22 at the first end 14 or 76 of the tool 10 or 72, respectively. In an example embodiment, fibers continue to pass through slot 18 reaching the second opening 24. The diameter of the second opening 24 is wider than slot 18. The diameter of first and second openings 22 and 24 is 0.005 to 0.025 inches (e.g., 120 μm to 635 μm).

The first and second openings 22 and 24 have circular cross sections, and secure fibers such that the fibers can move freely within said openings 22 and 24. The diameter of the first and second openings 22 and 24 is greater than the diameter of the fibers passing through the slot 18. In certain embodiments, the first opening 22 may be partially covered by an optional latch angled inwardly to deflect the passage of fibers into the second opening 24. The latch, manufactured from a resilient material, also serves to reduce the escape of any fibers unintentionally from tools 10 and 72.

Tools 10 and 72 can be manufactured from a variety of materials, including, for example, metal and plastic. In an example embodiment, tools 10 and 72 are formed using stainless steel. Stainless steel is strong, durable and resistant to corrosion during use and storage. In certain embodiments, tools 10 and 72 are manufactured from a single type of material having a consistent composition throughout. In further embodiments, tools 10 and 72 are formed using more than one type of material joined together, such that different materials are selected to provide individual elements of tool 10 or tool 72 for optimal performance.

During manufacture, tools 10 and 72 are shaped and hardened. Hardening can be accomplished using heat. The temperature and duration required to harden tools 10 and 72 depend on the type of material used for manufacture. Examples of techniques useful in the manufacture of tools 10 and 72 include but are not limited to stamping, laser, electronic discharge machining or combinations thereof. Tools 10 and 72 are then be ground and polished, followed by one or more coatings. Examples of coating materials include gold plating, nickel, silicon or similar materials.

Figure 4:
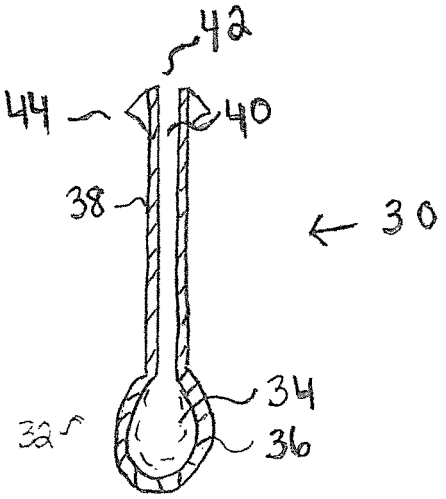
FIG. 4 is a sectional view of another example embodiment of a tool according to the present disclosure.

FIG. 4 shows an example embodiment of a tool 30 that can also be used for fixing fibers, such as natural hair, to a substrate, such as a wig cap, for making a wig. Tool 30 comprises a container 32 defining a volume 34 and having a smooth curved inner surface 36. A tube 38 extends from the container 32, defining a smooth bore 40 in fluid communication with the volume 34. The tube 36 has an open end 42 opposite to the container 32 for receiving fibers. The ends of one or more fibers (not shown) are inserted into container 32 via the open end 42 of tube 38. The ends of the fibers engage the smooth curved inner surface 34 and are then guided back into tube 36. In this example embodiment both ends of the one or more fibers are outside of tool 30 via the open end 42.

Container 32 has a bulbous shape. The height of container 32 is between 2 to 6 inches. The diameter of the container 32 is generally less than the height. The smooth curved inner surface 34 is capable of guiding fibers through the container 32 without capturing or snagging the fibers.

Tube 38 further comprises at least one projection 44 extending outwardly from the tube 38. In certain embodiments, tube 38 comprises a plurality of projections 44 that extend outwardly from the tube 38. The one or more projections 44 may be positioned near the open end 42 of the tube 38. The projections 44 are relatively rounded or angled and of an adequate size to provide support for holding tool 30.

Tube 38 is relatively firm with some flexibility. The length of the tube 38 is about 1 to 3 inches having an inner diameter of about between 0.002 to 0.020 inches (e.g., 50 μm to 500 μm). The inner diameter of the tube 38 and the diameter of the open end 42 are sufficient to accommodate one to two fibers. In certain embodiments, the diameter of the open end 42 is about between 0.002 to 0.020 inches (e.g., 50 μm to 500 μm).

The movement of at least one hair through the inside of tool 30 is smooth and without barrier or difficulty. The at least one projection 44 is used to hold the tool 30 and allow the receipt and release of at least one fiber through the open end 42 of the tube 38.

Tool 30 is manufactured using one or more resilient material(s). In an example embodiment tool 30 is manufactured using one material via a single molding operation. Different elements of tool 30 can be produced as one or more separate parts that then can be joined by an available method including gluing or press fit mounting. For example, tool 30 may be manufactured by forming the container 32 and tube 38 in one operation followed by optionally joining the at least one projection 44 in a second operation.

Tool 30 is produced using any suitable polymeric material. Features of such material(s) include but are not limited to 1) resilience, to give the container 32 elastic properties, and softness of tube 38 to minimize or avoid damaging the hair; 2) moldability, to provide a simple and inexpensive production; and 3) resistance to chemicals and sterilization. The material can be transparent to permit easy inspection of the inside of tool 30. An example of a suitable material includes but is not limited to silicone.

Figure 5:
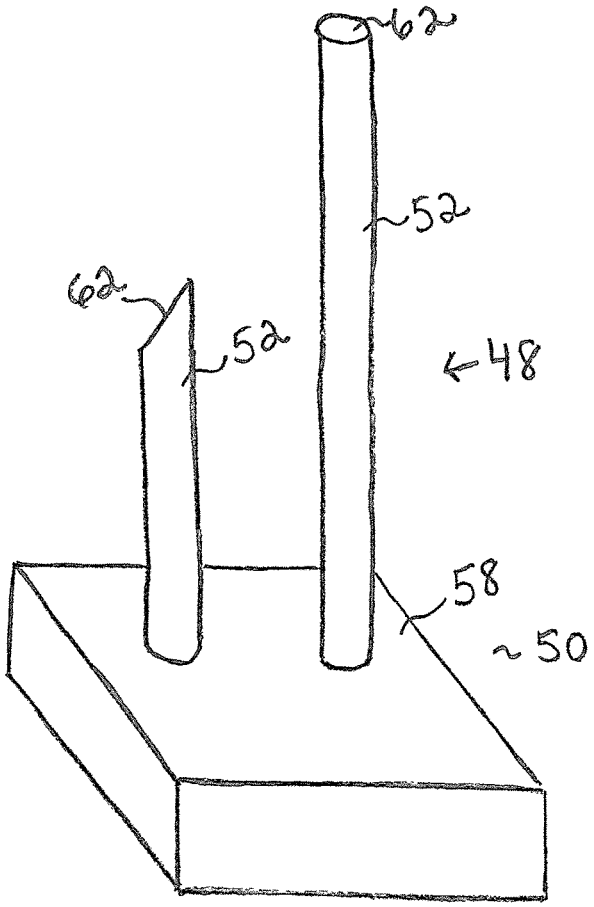
FIG. 5 is an isometric view of an example embodiment of a stand according to the present disclosure.
Figure 6:
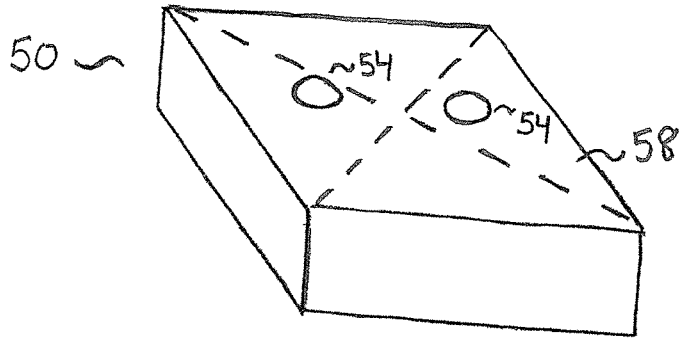
FIG. 6 is an isometric view of an example embodiment of the base of the stand according to the present disclosure.

FIG. 5 shows an example embodiment of a stand 48 for holding fibers, such as natural hair. Stand 48 comprises a base 50 having a top side 58 and a bottom side 60 (see, FIGS. 6 and 7, respectively). As shown in FIG. 6, top side 58 of base 50 has at least one recess 54 configured for complementarily receiving and securing at least projection 52 that extends transversely to the base 50. The at least one recess 54 is positioned such when at least one projection 52 is secured, the stand 48 maintains equilibrium. Top side 58 of base 50 can be configured with any number of recesses. In certain embodiments, the number of recesses is two or more. When there are two or more recesses 54, two or more projections 52 can be interchangeably and simultaneously secured to the base 50 with recesses 54 substantially equally spaced on the top side 58 of the base 50. In the absence of at least one recess 54 positioned on the top side 58 of the base 50, at least one projection 52 is molded to the top side 58 of the base 50. Base 50 is manufactured using any sturdy material including but not limited to plastic, metal or wood. Base 50 is of any shape such as square or rectangular. The side lengths may be between 5 to 8 inches or any combination thereof.

Referring to FIG. 5, projection 52 holds the hair for the wigmaker and comprises a first end 62 and a second end 64 (not shown). The first end 62 is of any shape (e.g., rounded or beveled). The second end 64 is secured to the top side 58 of the base 50. Projection 52 is of any diameter, length or shape. In certain embodiments, projection 52 has a diameter of about 0.01 inches to 3 inches. The length of projection 52 is about 2 inches to 16 inches. The length of projection 52 is sufficient to accommodate a plurality of fibers, ranging, for example, between 4 and 8 inches or between 8 inches to 24 inches (or longer). The length of projection 52 may depend on the length of the plurality of fibers and the packaging of the hairs (see below). In an example embodiment, projection 52 is rod-shaped and made from any sturdy material such as plastic, metal or wood.

Figure 7:
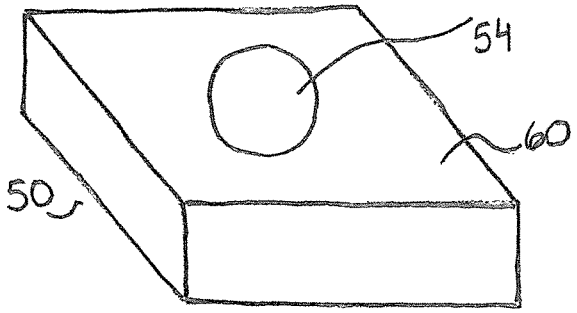
FIG. 7 is an isometric view of an example embodiment of the base of the stand according to the present disclosure.

FIG. 7 shows the bottom side 60 of the base 50 having an optional recess 54. Recess 54 is capable of securing the stand 48 to an instrument, device or other tool known to one of ordinary skill in the art to hold a wig head. Recess 54 is configured to receive a rod or other connecting element to secure the stand 48 to a surface. In an example embodiment recess 54 is radial cut to engage with a screw connecting element. Alternatively, stand 48 is placed on a table or work bench or can be held, for instance, between the knees of the wigmaker.

Figure 8:
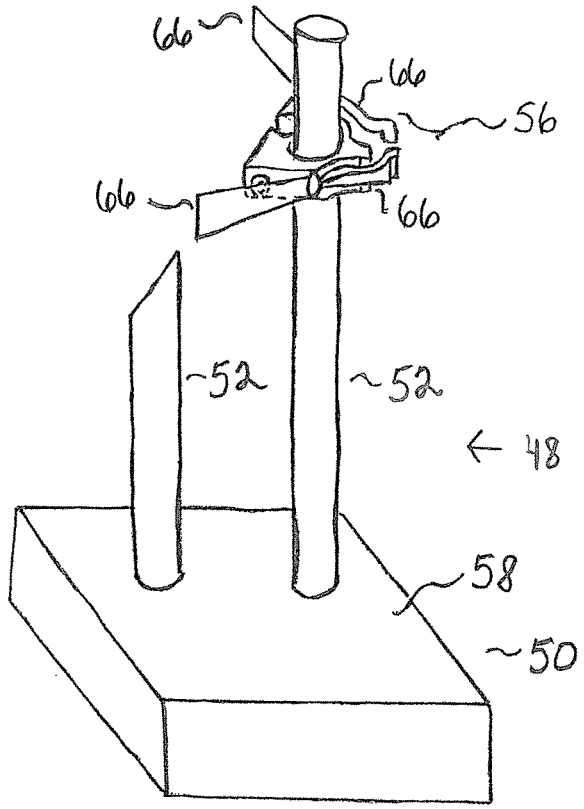
FIG. 8 is an isometric view of an example embodiment of the stand according the present disclosure.

FIG. 8 shows an example embodiment of at least one movable clamp 56 for securing hair to the stand 48. The at least one movable clamp is adapted to engage (e.g., grip) projection 52. For example and similar to a band clamp, the movable clamp 56 is adapted to encircle and grip the projection 52 forming a tight coupling using a set screw, for instance, to secure the movable clamp 56 to the projection 52. In an example embodiment movable clamp 56 can further comprise a pair of opposing gripping jaws 58 that can be spring biased closed and manually operable for holding or securing hair (e.g., a weft). The movable clamp 56 can perform both actions (receiving and gripping the projection 52 and holding hair) with a single motion, for example, by using a spring clamp. Alternatively, the movable clamp 56 can first receive and grip projection 52, for example, using a clamp such as or similar to a band clamp; and then holding hair using a spring clamp. Generally, the movable clamp 56 attaches to projection 52 and also holds hair bound to a weft. The number of movable clamps 56 used depends on the width of the weft. The movable clamp 56 is made from any sturdy material such as plastic, metal or wood.

A kit 46 for fixing fibers, such as natural hair, to a substrate, comprising one or more tools described herein, and a stand 48 for holding the fibers. In an example embodiment, the kit 46 comprises a first tool 10 and/or 72 and a second tool 30.

The article of manufacture can further include, for example, packaging materials, instructions for use (e.g., written or visual materials), plurality of hair samples, and netting. The kit 46 for making a wig can also include a legend (e.g., a printed label or insert or other medium describing the product's use (e.g., an audio- or videotape)). The legend can be associated with the container or packaging (e.g., affixed to the container or packaging) and can describe the manner in which the kit 46 comprises at least one tool 10, 30 and/or 72 or a combination thereof and stand 48 that can be used either together or individually.

The kit 46 or any of the tools 10, 30 and/or 72 described herein are useful in making hand-tied wigs. The tools 10, 30 and/or 72 used either alone or together simplify the traditional ventilating method for making a hand-tied wig; making the procedure easier and quicker, for instance, by permitting the wigmaker to have a free hand to carry out other tasks during the process.

Using tool 10, the wigmaker holds the shaft 12 in one hand while the other hand inserts one or more fibers (not shown) into slot 18 of the first end 14 through open end 20. Guide surfaces 68 and 70 direct the fibers to the first opening 22. Once the fibers enter the first opening 22, they are then manually pulled through the first opening 22 until about the midpoint of the length of the fibers is reached resulting in a U-shaped configuration with the "U" portion in the first opening 22. If using the stand 48, one end of the fibers may be secured to one of the projections 52 while the other end is free or unattached.

To secure the fibers to the substrate, for example, a wig cap, one of the guide surfaces 26 or 28 is placed under the netting opening selected on the wig cap. The edge 26 or 28 corresponding to the guide surface 68 or 70 is inserted and passed upwards and completely through the netting opening such that the "U" portion and tool 10 is through the netting opening and the ends of the fibers remain on the other side of the netting opening. Next, tool 10 moved is to meet the fiber ends to complete at least one knot (e.g., single knot, double knot, interlocking knot) thereby fixing the one or more fibers to the wig cap. In addition, tool 10 may be used to prepare extensions on hair (e.g., natural hair), for example, on flat braids and corn rolls.

A knot is made by passing the fibers through the U-shaped portion of fibers extending therefrom tool 10. Optional hook may be used to complete the knot. In an example embodiment the hook on the second end 16 of the shaft 12 is passed through the U-shaped portion of fibers extending from tool 10, forming the knot. Prior to tightening the knot, the fibers may be released from the first end 14 of the shaft 12. Any fibers secured to stand 48 are cut.

Following the steps described above, a knot may also be formed with fibers unattached to stand 48 or fibers that are cut before forming the knot. To fix fibers to the substrate, the free ends of the fibers are wrapped around the first end 14 of the shaft 12 or optional hook, and then tool 10 is pulled away from knot, thereby tightening the knot.

Using tool 72 to fixing fibers to a substrate, such as a wig cap, is carried out similar to tool 10. First, the wigmaker holds the shaft 74 in one hand while the other hand inserts one or more fibers (not shown) into slot 18 of the first end 76 through open end 20. Guide surfaces 80 and 82 direct the fibers to the first opening 22. Once the fibers enter the first opening 22, they are then manually pulled through the first opening 22 until about the midpoint of the length of the fibers is reached resulting in a U-shaped configuration with the "U" portion in the first opening 22. If using the stand 48, one end of the fibers may be secured to one of the projections 52 while the other end is free or unattached.

Next, guide surface 80 or 82 is placed under the netting opening selected on the wig cap. The edge 84 or 86 corresponding to the guide surface 80 or 82 is inserted and passed upwards and completely through the netting opening such that the "U" portion and tool 72 is through the netting opening and the ends of the fibers remain on the other side of the netting opening. Tool 72 is then moved to meet the fiber ends to complete at least one knot as described above thereby fixing the one or more fibers to the wig cap. In addition, tool 72 may be used to prepare extensions on hair (e.g., natural hair), for example, on flat braids and corn rolls.

When making a wig or hairpiece, tool 30 is generally used to fix hairs close to or near the hair line. Using tool 30, the wigmaker will use one hand to grip the tube 38 and the other hand to insert one to two fibers (not shown) into the smooth bore 40 of the tube 38 through open end 42. Open end 42 is manually adjusted by gently squeezing tube 38. Projection 42 may help the wigmaker maintain his or her grip on tube 38 while inserting fibers into tool 30 and securing the fibers to the substrate. The fibers are advanced through the smooth bore 40 reaching the volume 34 of container 32. With continued advancement, the fibers will reverse direction resulting in a U-shaped configuration with the "U" portion in the bottom of the container 32 with the free fiber ends exiting the open end 42 of the tube 38.

To secure fibers to the substrate, knots are made as described for tools 10 and 72 (see above). Briefly, the container 32 is positioned under an opening of the netting and inserted through the netting opening completely passing through such that tool 30 is on the opposite side of the netting opening. The unattached fibers or those secured to the stand 48 remain on the other side of the netting opening. Tool 30 is moved to meet the fibers to make at least one knot by passing the fibers through the U-shape portion of fibers extending therefrom. The fibers are then released from tool 30 either before or after the knot is formed or at any time after tool 30 is completely passed through the netting opening. The projection 52 may assist the wigmaker by permitting the free hand to bring fibers toward tool 30 to place in the U-shaped loop.

Stand 48 may be used with any of the tools 10, 30 and 72 described herein. Choosing to use one or more projections 52 depends on the type of wig or hairpiece to be created and/or the form the fibers being used (see below). Once selected, the projection 52 is secured to base 50. Using a weft, the bound end of the weft is secured to projection 52 via at least one movable clamp 56. The number of movable clamps 56 selected and their position on projection 52 is determined by the width of the weft. In certain embodiments, the projection 52 may have a beveled first end 62 for maintaining weaving thread or hair bundles not secured to a weft.

The fibers described herein are made from a variety of materials. In an example embodiment, the fibers are hair. Hair is made from any desirable material including synthetic fiber, natural fiber, and animal material. In certain embodiments, the hair is human hair or a synthetic fiber. Examples of synthetic fibers include but are not limited to polyester, acrylic, polyvinyl or other chemical fiber treated for use as artificial hair. Hair may have any diameter, for example, ranging from about 17 μM to 200 μM.

Generally, hair used to make wigs or hairpieces is available in the form of a hair weft. The width of the weft varies. In some instances, the wigmaker may make a weft when hair is in a bundle and not secured on a weft. Weaving thread generally comprises shorter hairs and is available on a spool.

The substrate serves as a foundation that is secured to, for instance, a wig head. Examples of foundations are mesh, nylon, netting, weaving or wig cap. Wig caps are available in a variety of styles. Examples of wig caps include but are not limited to hand-tied, monofilament, lace front and basic.

The tools and stand described herein can be used by anyone including a person with limited eyesight and/or reduced finger dexterity or a novice wigmaker so that the process of manufacturing a wig is easier than the currently available wig making needles and tools.

What is claimed is:

1. A tool for fixing fibers to a substrate, said tool comprising:

a shaft having first and second ends;

a slot extending from said first end of said shaft lengthwise therealong, said slot having an open end for receiving said fibers;

a first opening extending transversely to said shaft, said first opening intersecting said slot, said first opening being wider than said slot;

a second opening extending transversely to said shaft, said second opening intersecting said slot, said second opening being wider than said slot, said second opening being in spaced relation away from said first opening; and a first guide surface positioned at said first end of said shaft, said first guide surface being angularly oriented with respect to a longitudinal axis of said slot.

2. The tool according to claim 1, wherein said first opening has a circular cross section.

3. The tool according to claim 2, wherein said first opening has a diameter from 120 μm to 510 μm.

4. The tool according to claim 1, wherein said second opening has a circular cross section.

5. The tool according to claim 1, further comprising a second guide surface positioned at said first end of said shaft adjacent to said first guide surface, said second guide surface being angularly oriented with respect to said longitudinal axis of said slot.

6. The tool according to claim 5, wherein said first and second guide surfaces terminate in respective first and second rounded edges at said first end of said shaft.

7. The tool according to claim 1, wherein said shaft is curved.

8. The tool according to claim 1, further comprising a hook positioned at said second end of said shaft.

9. The tool according to claim 1, wherein said slot has a width from 50 μm to 500 μm.

* * * * *